US011298806B2

(12) United States Patent
Huddy

(10) Patent No.: US 11,298,806 B2
(45) Date of Patent: Apr. 12, 2022

(54) HAND TOOL HAVING A HEAD WHICH IS POSITION-ADJUSTABLE AND LOCKABLE RELATIVE TO A HANDLE

(71) Applicant: JS Products, Inc., Las Vegas, NV (US)

(72) Inventor: George Michael Huddy, Las Vegas, NV (US)

(73) Assignee: JS Products, Inc., Las Vegas, NV (US)

( * ) Notice: Subject to any disclaimer, the term of this patent is extended or adjusted under 35 U.S.C. 154(b) by 276 days.

(21) Appl. No.: 16/741,612

(22) Filed: Jan. 13, 2020

(65) Prior Publication Data

US 2020/0147767 A1 May 14, 2020

Related U.S. Application Data

(63) Continuation of application No. 14/548,634, filed on Nov. 20, 2014, now Pat. No. 10,532,448.

(51) Int. Cl.

| | |
|---|---|
| ***B25B 23/00*** | (2006.01) |
| ***B25B 13/46*** | (2006.01) |
| ***B25G 1/00*** | (2006.01) |
| ***B25G 1/06*** | (2006.01) |

(52) U.S. Cl.
CPC ..... *B25B 23/0028* (2013.01); *B25B 13/463* (2013.01); *B25G 1/005* (2013.01); *B25G 1/066* (2013.01)

(58) Field of Classification Search
CPC ..... B25B 23/0028; B25G 1/005; B25G 1/066
See application file for complete search history.

(56) References Cited

U.S. PATENT DOCUMENTS

| | | | |
|---|---|---|---|
| 2,671,367 | A | 3/1954 | Modin |
| 3,779,107 | A | 12/1973 | Avery |
| 4,327,611 | A | 5/1982 | Catanese et al. |
| 4,463,632 | A | 8/1984 | Parke |
| 4,794,829 | A | 1/1989 | Mesenhoeller |
| 5,199,335 | A | 4/1993 | Arnold et al. |
| 5,280,740 | A | 1/1994 | Ernst |
| 5,862,723 | A | 1/1999 | Rowlands |
| 5,871,204 | A | 2/1999 | Spirer |
| 6,000,302 | A | 12/1999 | Chiang |
| 6,016,726 | A | 1/2000 | Wright |
| 6,053,076 | A | 4/2000 | Barnes |
| 6,167,787 | B1 | 1/2001 | Jarvis |
| 6,216,567 | B1 | 4/2001 | Hu |
| 6,220,125 | B1 | 4/2001 | Lan |
| 6,336,383 | B1 | 1/2002 | Hung |
| 6,382,058 | B1 | 5/2002 | Owoc |
| 6,405,621 | B1 | 6/2002 | Krivec et al. |

(Continued)

OTHER PUBLICATIONS

PCT International Search Report and Written Opinion for PCT/US2015/061231 dated Jan. 29, 2016, in 14 pages.

*Primary Examiner* — David B. Thomas
(74) *Attorney, Agent, or Firm* — Weide & Miller, Ltd.

(57) ABSTRACT

A hand tool includes a head and a handle. The head is pivotally mounted to the handle, permitting the position of the head to be changed relative to the handle. In addition, the tool includes a primary locking mechanism and a secondary locking mechanism. The primarily locking mechanism primarily fixes the head relative to the handle in a particular position. The secondary locking mechanism can be used to further lock the head and handle. The locking mechanisms are actuated by movement of a sleeve which is located on the handle.

10 Claims, 8 Drawing Sheets

(56) References Cited

U.S. PATENT DOCUMENTS

| | | | |
|---|---|---|---|
| 6,516,690 | B2 | 2/2003 | Chen |
| 6,557,442 | B1 | 5/2003 | Owoc |
| 6,886,430 | B1 | 5/2005 | Tremblay et al. |
| 7,000,507 | B1 | 2/2006 | Lin |
| 7,047,846 | B1 | 5/2006 | Hu |
| 7,051,625 | B1 | 5/2006 | Lee |
| 7,131,356 | B2 | 11/2006 | Lin |
| 7,165,480 | B2 | 1/2007 | Lin |
| 7,171,875 | B2 | 2/2007 | Hu |
| 7,197,966 | B1 | 4/2007 | Hsieh |
| 7,318,366 | B2 | 1/2008 | Lee et al. |
| 7,509,893 | B2 | 3/2009 | Wu |
| 7,581,468 | B2 | 9/2009 | Wu |
| 7,841,262 | B1 | 11/2010 | Tsai |
| 7,992,471 | B2 | 8/2011 | Tsai |
| 8,028,607 | B2 | 10/2011 | Lee et al. |
| 8,245,604 | B2 | 8/2012 | Chen |
| 8,276,485 | B1 | 10/2012 | Chen |
| 8,474,350 | B2 | 7/2013 | Lee et al. |
| 8,671,809 | B1 | 3/2014 | Chen |
| 8,695,459 | B2 | 4/2014 | Lee et al. |
| 9,327,388 | B2 | 5/2016 | Chen |
| 2001/0000092 | A1 | 4/2001 | Jarvis |
| 2005/0268753 | A1 | 12/2005 | Lin |
| 2011/0185861 | A1 | 8/2011 | Hu |
| 2013/0269491 | A1 | 10/2013 | Chang |

HAND TOOL HAVING A HEAD WHICH IS POSITION-ADJUSTABLE AND LOCKABLE RELATIVE TO A HANDLE

CROSS-REFERENCE TO RELATED APPLICATION

This application claims priority to and is a continuation of U.S. patent application Ser. No. 14/548,634 which was filed on Nov. 20, 2014, the contents of which is incorporated by reference.

FIELD OF THE INVENTION

The present invention relates to tools which have position-adjustable heads

BACKGROUND OF THE INVENTION

Many hand tools have a work piece engaging head and a user-engageable handle for driving the head. Commonly, the head is fixed in a position in which it is aligned with the handle. However, in many instances, that fixed position makes it difficult for a user to engage a work piece and engage or move the handle.

In some instances, the head of the tool can be moved relative to the handle. For example, a ratchet head may be pivotally mounted to the handle. This allows the user to change the angle of the handle relative to the head. A problem, however, is that during use the user may find it difficult to maintain the position of the handle while effectively transmitting force through the handle to the head.

A hand tool which has a position adjustable head but which permits the position of the head to be maintained relative to the handle, is desired.

SUMMARY OF THE INVENTION

One aspect of the invention is a tool which has at least two portions, wherein one portion is position adjustable relative to the other portion. Another aspect of the invention is a tool having a locking mechanism which is configured to secure or lock a first portion of a tool in one or more positions relative to a second portion of the tool.

In a preferred embodiment, the tool is a hand tool having a handle portion and a head portion, wherein the head portion is position-adjustable relative to the handle portion, such as via a joint. The hand tool includes at least one locking mechanism for fixing the position of the head portion relative to the handle portion.

In a preferred embodiment, the tool has a primary locking mechanism and a secondary locking mechanism. When the primary and secondary locking mechanisms are not engaged, the head may be moved relative to the handle, such as to change the angular position of the head relative to the handle.

The primary locking mechanism may be engaged to provide primary fixing or locking of the head relative to the handle. In one embodiment, the primary locking mechanism may comprise one or more locking balls which are moved into engagement with detents in the head.

The secondary locking mechanism may be engaged to provide secondary or additional fixing or locking of the head relative to the handle. In one embodiment, the secondary locking mechanism may only be engaged when the head and handle are in a specific orientation, such as in alignment with one another along a common axis, such as for when the tool is to be used as a breaker bar.

In one embodiment, the secondary locking mechanism comprises a sleeve which is mounted on the handle and which can be moved between a first position and a second position. In the second position, the sleeve is moved forwardly into engagement with the head, such to cause a tab on a collar of the head to be moved into engagement with a recess on the sleeve or collar. The inter-engagement of the collar and sleeve preferably serve to further limit movement of the head relative to the handle.

In a preferred embodiment, movement of the sleeve also selectively engages the primary locking mechanism, such as by actuating an actuator which moves the one or more balls. In one embodiment, the sleeve or collar may be moved from: (1) a first retracted position in which the primary and secondary locking mechanisms are not engaged; (2) a second forward position in which the sleeve is moved forward on the handle towards the head, thus engaging the primary locking mechanism; and (3) a second forward position in which the sleeve is moved further forward on the handle towards the head, thus engaging both the primary and secondary locking mechanism.

Further objects, features, and advantages of the present invention over the prior art will become apparent from the detailed description of the drawings which follows, when considered with the attached figures.

DETAILED DESCRIPTION OF THE INVENTION

In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

One embodiment of the invention is a tool which has at least two portions wherein one portion is position adjustable relative to the other portion. Another aspect of the invention is a tool having a locking mechanism which is configured to secure or lock a first portion of a tool in one or more positions relative to a second portion of the tool.

In a preferred embodiment, the tool is a hand tool having a handle portion and a head portion, wherein the head portion is position-adjustable relative to the handle portion, such as via a joint. The hand tool includes at least one locking mechanism for fixing the position of the head portion relative to the handle portion.

Figure 1:
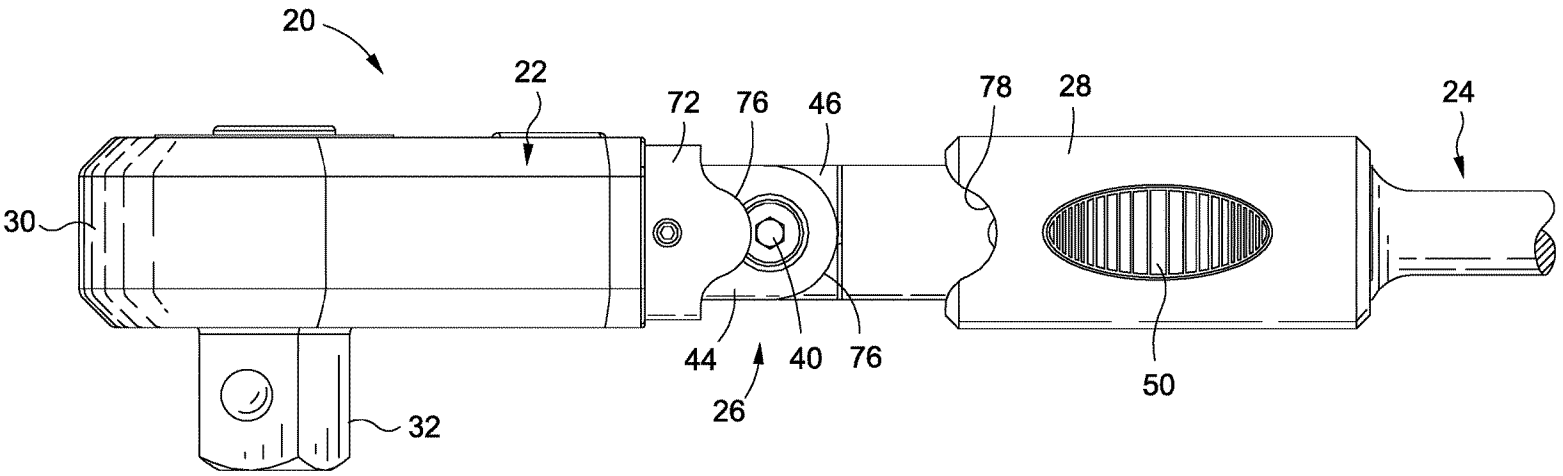
FIG. 1 is a side view of a hand tool in accordance with an embodiment of the invention.
Figure 2:
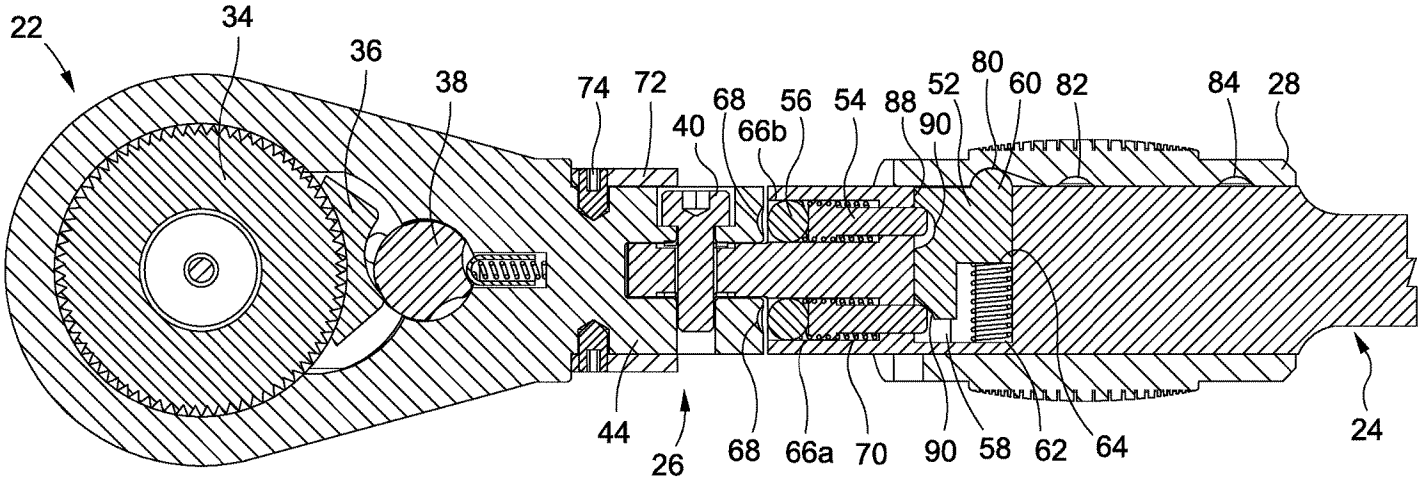
FIG. 2 is a cross-sectional view of the hand tool illustrated in FIG. 1, taken along line 2-2 therein.

One embodiment of the invention will be described first with reference to FIGS. 1-3. As illustrated in FIG. 1, a tool 20 has a head or head portion 22 and a handle or handle portion 24. In a preferred embodiment, the position of the head 22 may be changed or varied relative to the handle 24, such as via a joint 26. In addition, the position of the head 22 relative to the handle 24 may be fixed or locked via at least one locking mechanism which includes a sleeve switch 28.

In one embodiment, the head 22 of the tool 20 may comprise a ratchet head. So configured, as illustrated in FIG. 2, the head 22 may comprise a body 30 which rotatably supports a drive element 32. As illustrated, the drive element 32 may comprise a socket drive, such as a ¼", ⅜", ½" or other socket head drive. As indicated, the drive element 32 may be driven by a ratcheting mechanism which includes a main drive gear 34 which is associated with the drive element 32 and a ratchet gear 36 which selectively engages the drive gear 34. In the embodiment illustrated, the ratchet mechanism includes a drive selector 38 in the form of a rotatable selector (see FIG. 3), which permits the user to change the drive direction of the ratchet mechanism. In use, movement of the head 22 via the handle 24 causes the ratchet gear 36 to engage the main drive gear 34 and move the drive element 32, such as to rotate a work piece (such as a nut, bolt or the like) clockwise or counter-clockwise.

The ratchet head of the invention is just one example of a tool head which may be utilized. It will be appreciated that other types of ratcheting mechanisms may be used, including those which are now known or later developed. In addition, the tool head might comprise a fixed socket drive or entirely other types of tool heads (Allen wrenches, Phillips or standard screw drives, star drives, or various other work piece engaging tools or elements now know or later developed).

Most importantly, the position of the head 22 may be changed relative to the handle 24. In one embodiment, the joint 26 is configured to permit the head 22 to pivot relative to the handle 24. Referring to FIG. 2, the joint 26 may include a connecting pin 40 which joins the handle 24 and the head 22 and permits the head 22 to be rotated about the axis of the pin 40 relative to the handle 24.

Figure 3:
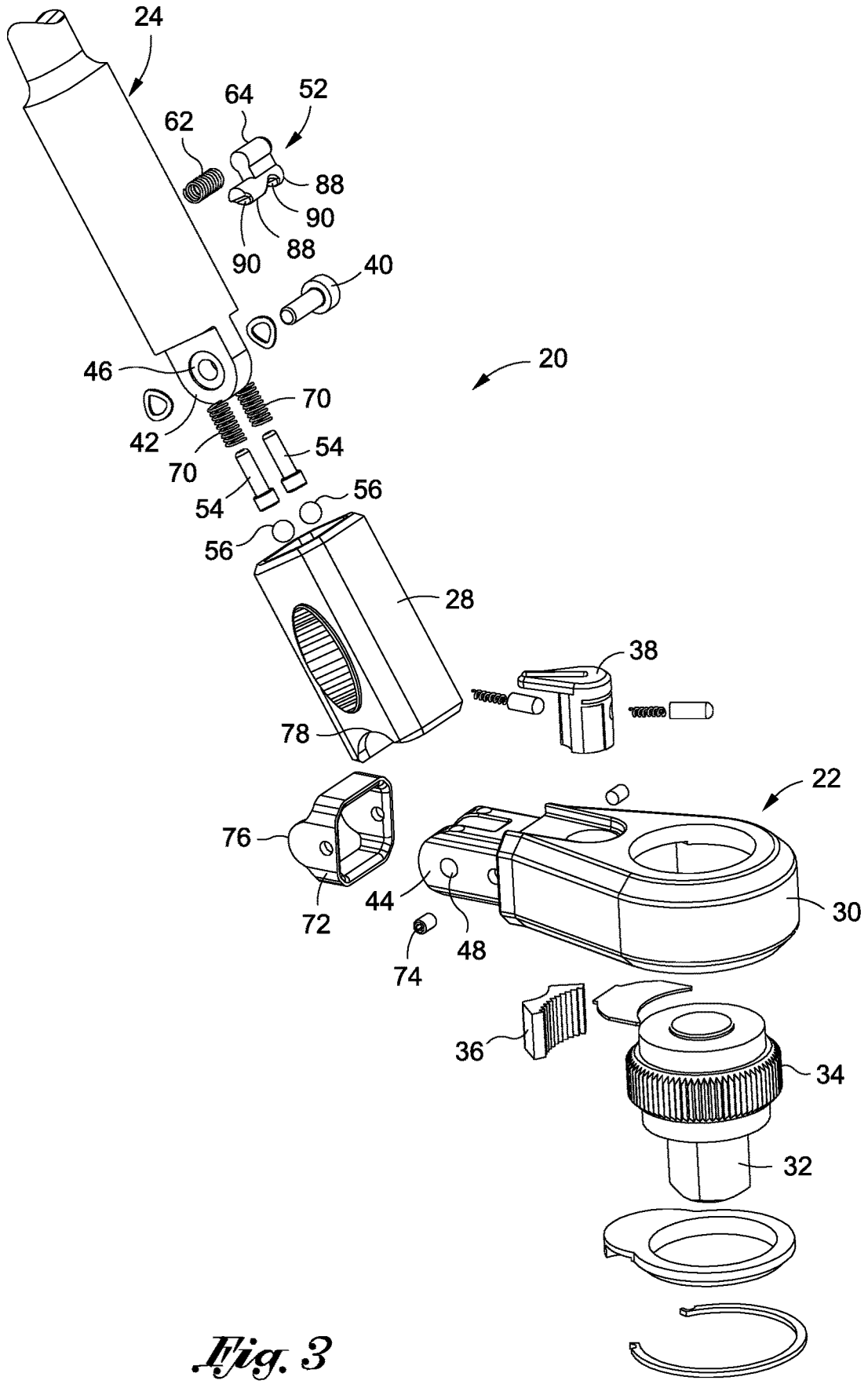
FIG. 3 is an exploded view of the hand tool illustrated in FIG. 1.

Referring to FIG. 3, in one embodiment the handle 24 has a first end or portion and a second end or portion. The head 22 of the tool 20 may be mounted to the first end of the handle 24. One or more grips or the like may be mounted on the handle 24, such as at the second end thereof. The length of the handle 24 may vary, such as depending upon the desired use of the tool 20. For example, the handle 24 might be 6-12 inches long for use in tight locations. In a preferred embodiment, the handle 24 may be relatively long, such as 20-36 inches long, to permit the tool 20 to be used as a breaker bar. In some embodiments, the handle 24 may be extendable, such as telescoping or having multiple interchangeable segments, to permit the length of the handle to be changed.

As illustrated, the first end of the handle 24 includes a head mount 42. The head 22 preferably includes a mating handle mount 44. In one embodiment, the head mount 42 of the handle 24 comprises an outwardly extending, centrally located flange. The handle mount 44 of the head 22 preferably comprises a pair of spaced flanges having an intermediate slot for accepting the head mount 42 therein. As described below, at least the ends of the flanges of the handle mount 44 are preferably arcuate, such as being semi-circular.

As illustrated, a passage 48 extends through the flanges of the handle mount 44 of the head 22. A mating passage 46 also extends through the head mount 42 of the handle 24. The mounting pin 40 is configured to engage the passage, thus preventing the head 22 from being disconnected from the handle 24, but permitting the head 22 to pivot or rotate relative to the handle 24 about an axis of rotation through the pin 40.

While the tool 20 is preferably configured to permit the position of the head 22 to be changed relative to the handle 24, most preferably the tool 20 also includes means for fixing the position of the head 22 relative to the handle 24. In one embodiment, this means comprises a primary locking mechanism and a secondary locking mechanism.

In one embodiment, the primary locking mechanism comprises a user-actuatable switch which is configured to actuate one or more locking members. As illustrated in FIG. 1, the switch comprises a sleeve switch 28. In one embodiment, the sleeve switch 28 comprises a member which is mounted on the handle 24 for movement relative to the handle 24. In one embodiment, the sleeve switch 28 has the form of a sleeve or collar which is generally hollow, defining a passage through which the handle 24 extends.

Preferably, the sleeve switch 28 is moveable axially along the handle 24. In order to aid the user in moving the sleeve switch 28, one or more grips 50 or the like may be associated with, mounted on or defined by the switch 28. For example, in one embodiment, the sleeve switch 28 may comprise a metallic sleeve. The grip 50 might comprise, for example, a plastic or rubber member. The grip 50 might be mounted in a recessed exterior area of the sleeve switch 28.

In a preferred embodiment, the sleeve switch 28 is configured to selectively actuate a locking member. Referring to FIG. 2, in one embodiment the locking member comprises an actuator 52, at least one plunger 54, and at least one ball 56. In the configuration illustrated, the actuator 52 comprises a body which is mounted for movement transverse to an axis of the handle 24 (and parallel to the axis of rotation of the head 22 relative to the handle 24). As illustrated, the handle 24 defines recess 58. The actuator 52 is generally housed within the recess 58. The actuator 52 preferably defines at least one projection 60. The projection 60 is configured to extend outwardly of the handle 24 for engagement by the sleeve switch 28.

In a preferred embodiment, means are provided for biasing the actuator 52 out of the recess 58 defined by the handle 24 and into engagement with the sleeve switch 28. In one embodiment, this means comprises at least one spring 62. As illustrated, the actuator 52 preferably defines a seat 64. In one embodiment, the seat 64 comprises a recessed area which is generally opposite the projection 60. In this configuration, a coil spring 62 is located in the handle recess 58 and the seat 64. The spring 62 thus biases the actuator 52 outwardly towards the sleeve switch 28. The means for biasing might comprise other elements, such as other types of springs, elastic members, pressurized fluid or other elements.

Preferably, the actuator 52 is configured to selectively engage the plunger(s) 54. In the embodiment illustrated, the locking member comprises two plungers 54. As illustrated, the handle 24 defines first and second passages 66*a,b* which extend from the recessed area 58 to the first end of the handle 24 (and along axes which extend parallel to an axis of the handle 24). In one embodiment, the two passages 66*a,b* terminate on either side of the head mount 42.

One plunger 54 is mounted in the first passage 66*a* and another plunger 54 is mounted in the second passage 66*b*. Each plunger 54 preferably has a first end and a second end. A first end of each plunger 54 extends into the recess 58 for engagement by the actuator 52. The second end of each plunger 54 is configured to engage a ball 56. In one embodiment, each plunger 54 comprises a generally cylindrical shaft.

The balls 56 preferably define a spherical or hemi-spherical surface for selectively engaging a mating detent 68 in the head 22. As illustrated, a ball 56 is positioned adjacent to the second end of each plunger 54, so that movement of each plunger 54 effects movement of an adjacent ball 56. As illustrated, the balls 56 are at least partially located in the passages 66*a,b*.

In a preferred embodiment, means are provided for biasing the locking member to an unlocked position, i.e. a position where the head 22 can be freely moved relative to the handle 24. In one embodiment, the means comprises a biasing member which is associated with each ball 56 and plunger 54. As illustrated, the means comprises at least one spring 70 which is associated with each ball 56 and plunger 54. The at least one spring 70 preferably biases its respective ball 56 and plunger 54 rearwardly towards the actuator 52, and thus biases the ball 56 away from the locking detent 68 of the head 22. Again, the means for biasing might comprise other than coil type springs, such as other types of springs or elastic members, fluid pressure, a counter mass or the like. In other embodiments, the plungers 54 might actually ride in tracks or slots in the actuator 60, where movement along the tracks cause the plungers 54 to move in and out (along with the balls). It is noted that the balls 56 might be integral to the plungers 54, such as by having a head of each plunger 54 be hemi-spherical.

As described in more detail below, at one or more times the balls 56 may be moved to a position in which they engage the head 22. In one embodiment, the head 22 defines one or more detents 68 corresponding to each ball 56. In one embodiment, the detents 68 are located in the end of the handle mounts 44. Each detent 68 preferably comprises an inwardly extending recess or depression for accepting at least a portion of a ball 56. As described below, multiple detents 68 may be located in positions around the generally arcuate ends of the handle mounts 44, thus permitting the balls 56 to engage the head 22 in different positions, as detailed below.

As indicated, the first end of each plunger 54 is configured to engage the actuator 52. In one embodiment, the actuator 52 has one or more first portions 88 and one or more second portions 90. The second portions 90 preferably comprise recessed areas which permit the first ends of the plungers 54 to extend into the recess 58 and into a recessed position in which the balls 56 are not located in the detents 68 of the head. The first portions 88 comprise outwardly extending portions which, when engaging the first ends of the plungers 54, push the plungers 54 out of the recess 58 and thus push the balls 56 into engagement with the detents 68 in the head 22.

In one embodiment, the tool 20 also includes a secondary locking mechanism. In one embodiment, the secondary locking mechanism comprises a collar 72 associated with the head 22, which collar 72 is configured to selectively engage the sleeve switch 28.

The collar 72 may be formed as part of the head 22 or, as illustrated, may comprise a separate element which is connected or mounted to the head 22. As illustrated, the collar 72 may comprise a sleeve-like body which is positioned over a portion of the handle mount 22 and may be attached to the head 22 with one or more fasteners 74 or the like.

In one embodiment, the collar 72 and the sleeve switch 28 are configured to engage one another in a manner which limits relative movement between the two members. Preferably, the collar 72 and sleeve switch 28 include means for limiting rotation of the elements relative to one another, thus limiting rotational movement of the head 22 relative to the handle 24. In one embodiment, as illustrated in FIG. 1, the means comprises at least one outwardly extending tab 76 of the collar 72 for engagement with a mating detent or recess 78 of the sleeve switch 28. An advantage of this configuration is that locking may be achieved merely by moving the sleeve switch 28 linearly along the handle 24 into engagement with the head 22. Other means might be utilized. For example, the sleeve switch 28 might be movable to a position in which a pin may be extended there through and into the head 22. The sleeve switch 28 might include a threaded collar which can be rotated into engagement with mating threads on the head 22. In general it is desired that the sleeve switch 28 be moveable to a position in which it extends over the joint 26, thereby limiting movement of the joint 26. In addition, it is preferable that this position of the sleeve switch 28 be maintainable (to prevent the sleeve switch 28 from unintentionally moving from over the joint 28) such as by using a locking or connecting feature.

In one embodiment, tabs 76 are located on opposing sides of the collar 72 for engagement with mating detents 78 which are located on opposing sides of the sleeve switch 28. In one embodiment, the tabs 76 are arcuate, outwardly extending bodies having a mating shape to arcuate, inwardly extending recesses comprising the sleeve switch 28.

As described below, the sleeve switch 28 may be moved to various positions. Thus, in one embodiment, the sleeve switch 28 includes a plurality of actuator projection 60 engaging features. As illustrated, the sleeve switch 28 defines a first detent 80, a second detent 82 and a third detent 84. Each detent is preferably defined on an inner surface of the sleeve switch 28 and is positioned to, at one or more times, engage the at least one projection 60 of the actuator 52. In an embodiment where the projection 60 is generally hemi-spherical in shape, the detents 80,82,84 may be similar in mating shape. In a preferred embodiment, the first detent 80 has a sufficient depth to permit the actuator 52 to be biased outwardly to the position illustrated in FIG. 2 in which the plungers 54 are associated with the second portions 90 of the actuator 52 (and thus the plungers 54 and their associated balls 56 are biased rearwardly out of engagement with the head 22). The second and third detents 82,84 are preferably smaller in depth, thus causing the sleeve switch 28 to press the actuator 52 inwardly to a position in which the first portions 88 thereof engage the plungers 54 and the plungers 54 press the balls 56 into engagement with the head 22.

Additional details of the tool 20 of the invention will be appreciated from a description of the operation thereof.

As one aspect of the invention, the position of the head 22 of the tool 20 may be changed or varied relative to the handle 24. As illustrated in FIGS. 2 and 4C, when the sleeve switch 28 is moved to a rearward position, the projection 60 of the actuator 52 is located in a forward-most detent 80 of the sleeve switch 28. So positioned, the first ends of the plungers 54 are located in the second portions 90 of the actuator 52. At this time, the springs 70 thus biasing the plungers 54 into the handle 24 and away from the head 22. Thus, as this same time, the balls 56 are biased out of engagement with the detents 68 in the head 22.

Figure 5:
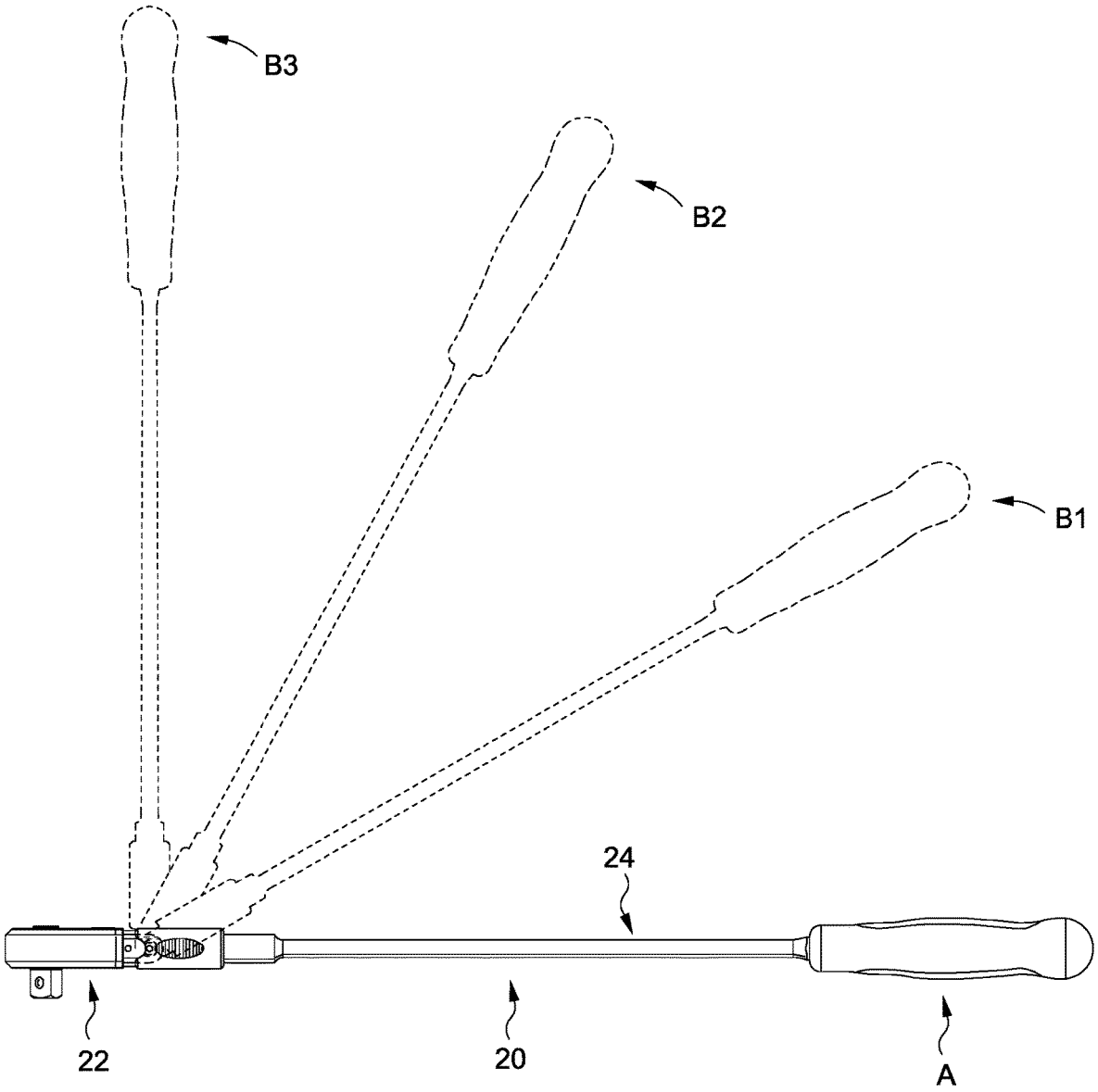
FIG. 5 illustrates different positions of the hand tool illustrated in FIG. 1.

Because the primary locking mechanism is not engaged, the head 22 can be pivoted or rotated relative to the handle 24 via the joint 26. In particular, as illustrated in FIG. 5, the head 22 can be moved to: (1) a position A in which it is aligned with the handle 24 and (2) one or more positions B, B2 and B3 in which the head 22 is offset from the handle 24, such as being offset at angles of 30, 60 and/or 90 degrees thereto.

Of course, the head 22 may be movable to other positions relative to the handle 24, such as beyond 90 degrees or at angles other than 0, 20, 60 and 90 degrees. However, while the head 22 may be moved to various angles, such as any angle between 0 and 90 degrees, in one embodiment the head 22 and handle 24 are configured to be fixable in one or more specific positions relative to one another. In one embodiment, those positions are 0 degrees, 30 degrees, 60 degrees and 90 degrees, as illustrated in FIG. 5. In particular, in one embodiment, the head 22 has a plurality of sets of detents 68. The detents 68 are spaced about the surface of the handle mount 44 of the head 24.

In one embodiment, a user may move the head 22 and handle 24 relative to one another to a desired position. The user may then engage the primary locking mechanism in order to fix or lock the head 22 relative to the handle 24. The user slides the sleeve switch 28 forward along the handle 24 towards the head 22 until it reaches the second detent 82, as illustrated in FIGS. 2 and 4B. At that time, the sleeve switch 28 presses the actuator 52 inwardly against the spring 62. As the actuator 52 moves downwardly, it presses the plungers 54 towards the head 22. As the plungers 54 move towards the head 22, they press the locking balls 56 forwardly into engagement with one of the sets of detents 68 in the head 22. At that time, movement of the head 22 relative to the handle 24 is prevented.

At one or more times, the user may also engage the secondary locking mechanism. The secondary locking mechanism is particularly suited to use of the tool 20 as a breaker bar. Thus, in a preferred embodiment, the secondary locking mechanism fixes the tool 20 in a position in which the head 22 and handle 24 are aligned, as shown in FIG. 1 and in FIG. 5 at position A.

The user may move the tool 20 in to the breaker bar position by moving the sleeve switch 28 rearwardly along the handle 24 away from the head 22 (thus disengaging the primary locking mechanism, if it is already engaged). Once the tool 20 is in this position, the user may move the sleeve switch 28 forwardly along the handle 24 towards the head 22 until it reaches the third detent 84. At that time, the primary locking mechanism is engaged in the manner described above.

Figure 4A:
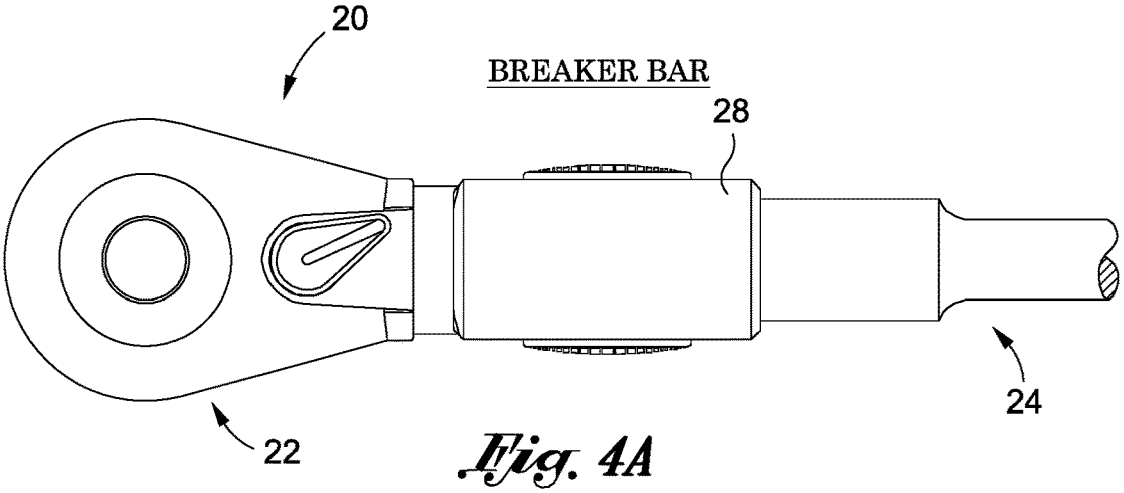
FIGS. 4A-4C illustrate multiple modes of operation of the hand tool illustrated in FIG. 1.
Figure 4B:
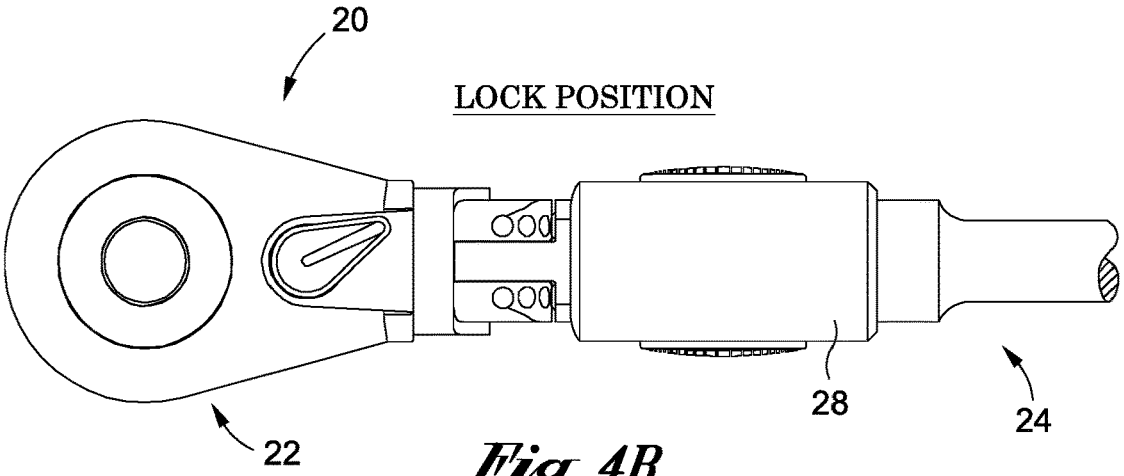
Figure 4C:
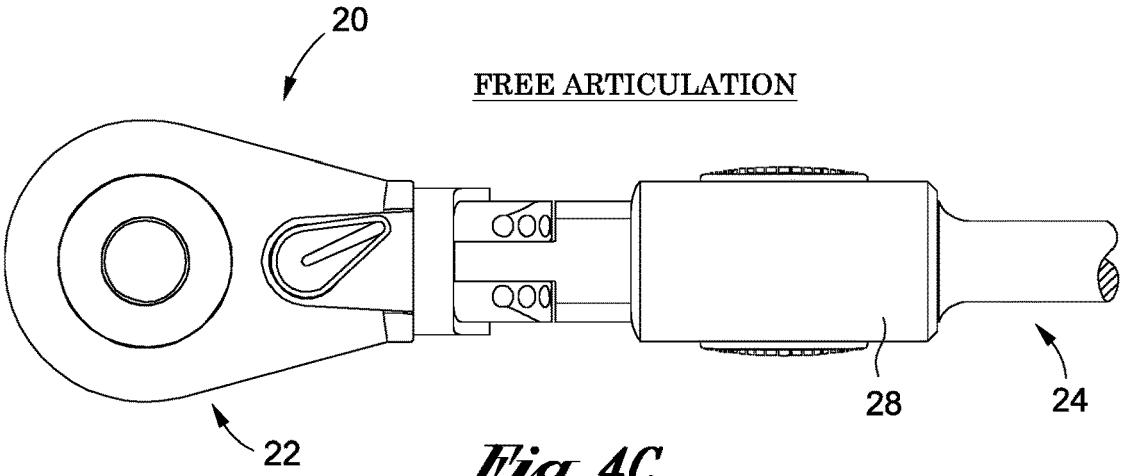

In addition, as illustrated in FIG. 4, the secondary locking mechanism is engaged. In particular, the tabs 76 of the collar 72 extend into the recesses 78 of the sleeve switch 28. This engagement provides additional locking of the head 22 relative to the handle 24. This locking includes an additional mechanical connection between the head 22 and the handle 24 which serves to transmit additional force between the two, thus permitting a larger force to be applied through the handle 24 to the head 22, such as when the tool 20 is to be used as a breaker bar.

A second embodiment of the tool is shown in FIGS. 6-14. In the following description of the second embodiment, the same reference numbers are used for features of the second embodiment that are substantially similar to that of the first embodiment, and a description of these repeated features will be omitted.

FIGS. 6-14 show a tool 120 according to a second embodiment. Similar to the tool 20, the tool 120 comprises head 122 and a handle 124. The position of the head 122 may be changed or varied relative to the handle 124, such as via a joint 126. Further, the position of the head 122 relative to the handle 124 may be fixed or locked via at least one locking mechanism which includes a sleeve switch 128.

In this embodiment, a joint 126 is configured to permit the head 122 to pivot relative to the handle 124. The joint 126 may include a connecting pin 140 (see FIG. 9) which joins the handle 124 and the head 122 and permits the head 122 to be rotated about the axis of the pin 140 relative to the handle 124.

Figure 8:
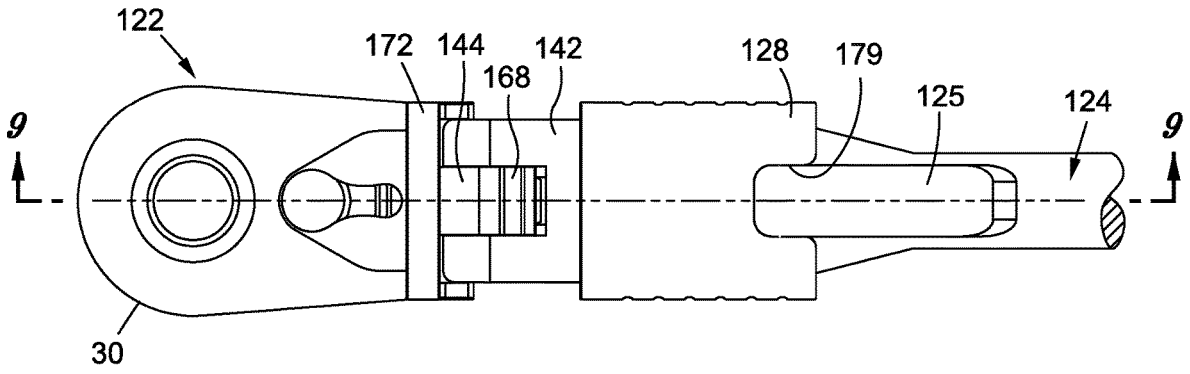
Figure 9:
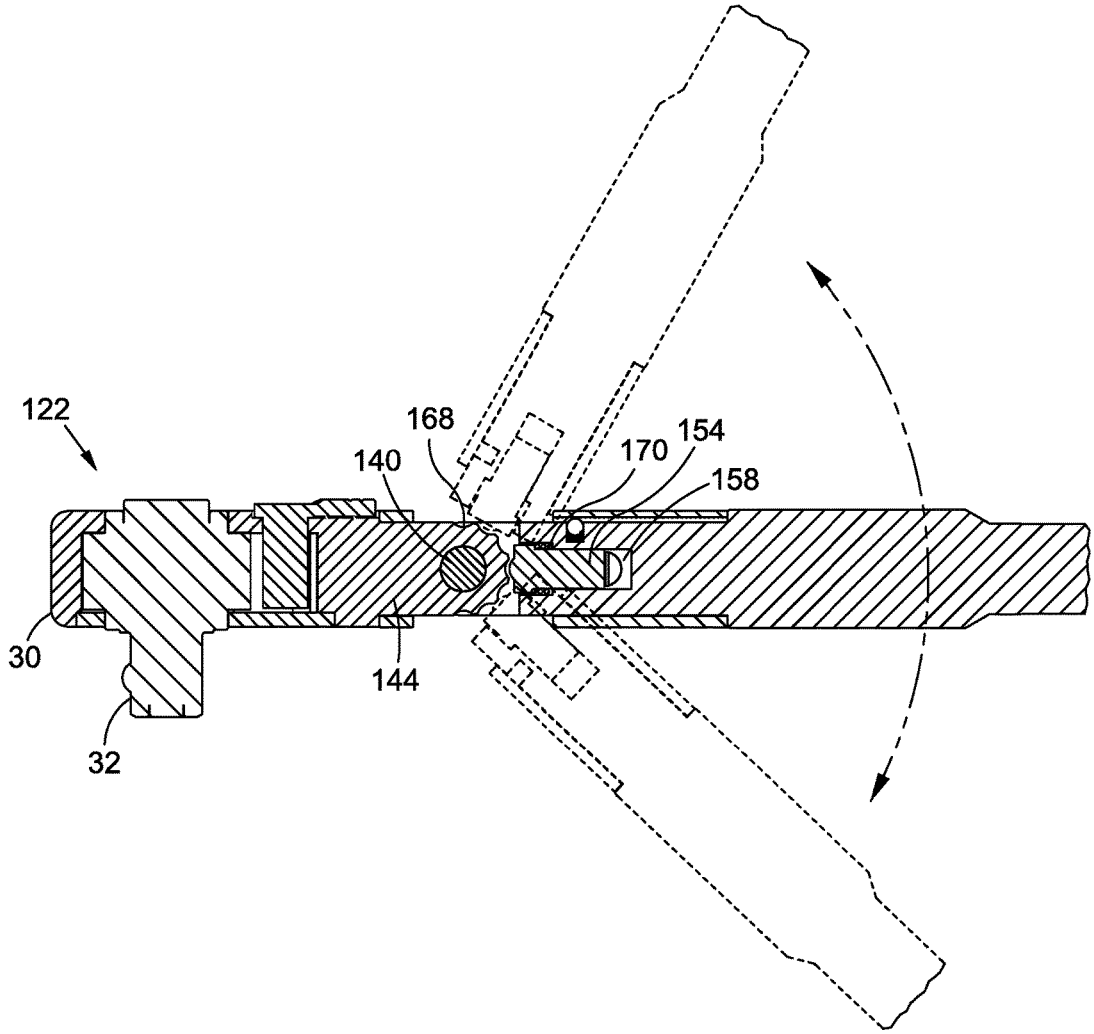

Referring to FIGS. 8 and 9, the head 122 of the tool 120 may be mounted to the first end of the handle 124. In this embodiment, the first end of the handle 124 includes a head mount 142. The head 122, in this embodiment, preferably includes a mating head mount 144. In this embodiment, the head mount 144 of the head 122 comprises an outwardly extending, centrally located flange. The head mount 142 of the handle 124 preferably comprises a pair of spaced flanges or a yoke having an intermediate slot for accepting the head mount 144 therein. At least the ends of the flanges of the head mount 142 are preferably arcuate, such as being semi-circular.

Figure 14:
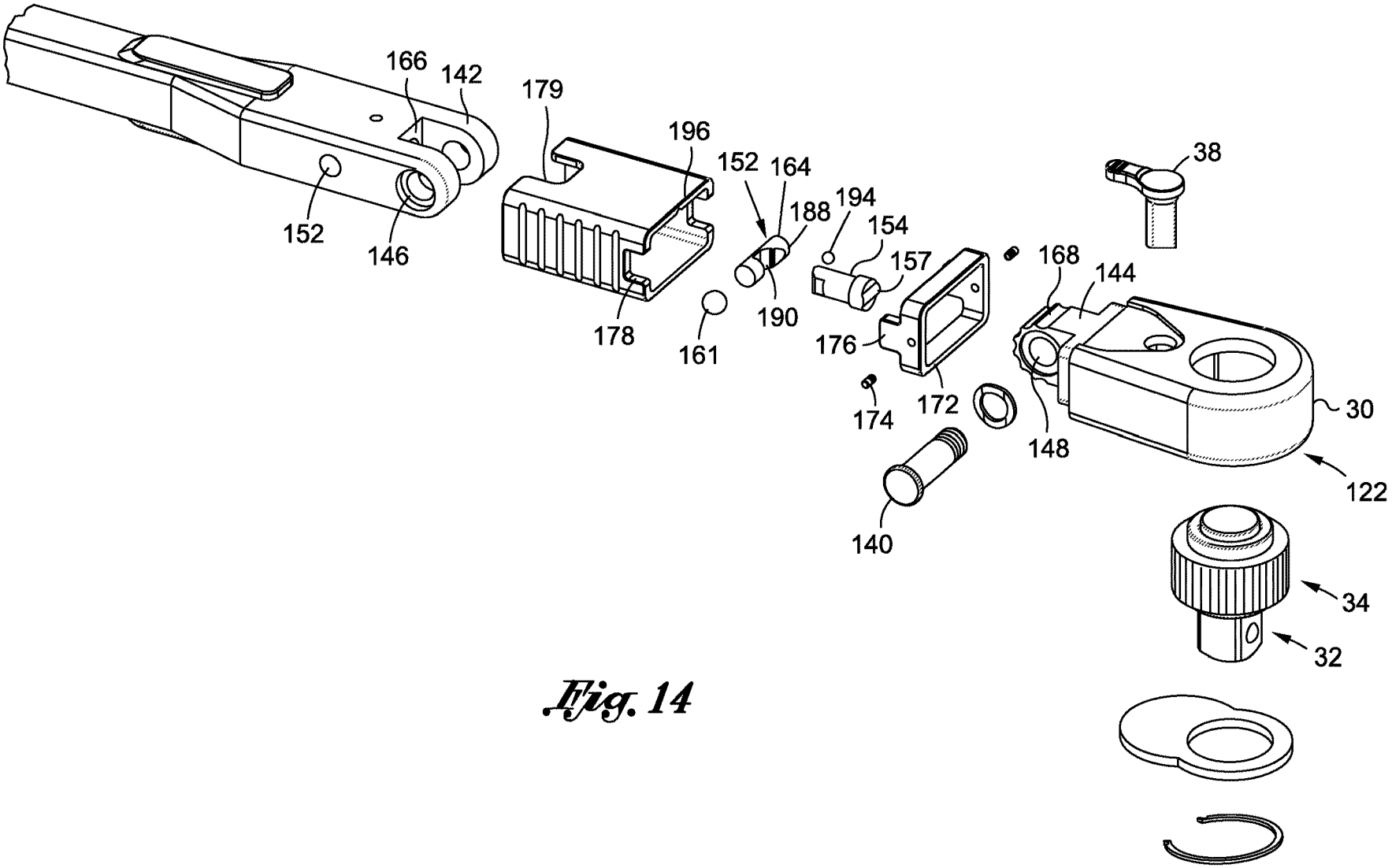

As illustrated in FIG. 14, a passage 148 extends through the flange of the head mount 144 of the head 122. Mating passages 146 also extends through the flanges of the head mount 142 of the handle 124. The mounting pin 140 is configured to engage the passages 146, 148, thus preventing the head 122 from being disconnected from the handle 124, but permitting the head 122 to pivot or rotate relative to the handle 124 about an axis of rotation through the pin 140.

Similar to tool 20, this embodiment includes at least one means for selectively fixing the position of the head 122 relative to that of the handle 124. This means similarly comprises a primary locking mechanism and a secondary locking mechanism.

Figure 6:
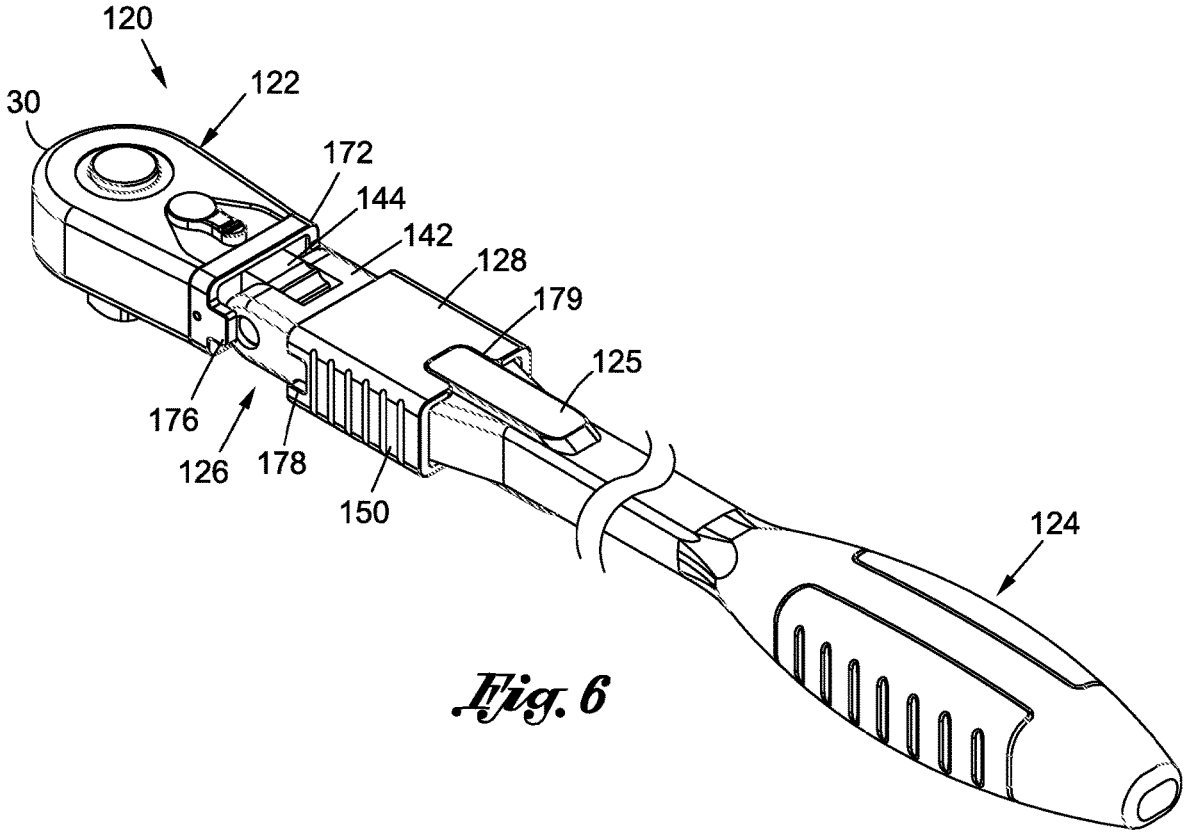
FIGS. 6-14 illustrate another embodiment of a hand tool in accordance with the invention.
Figure 7:
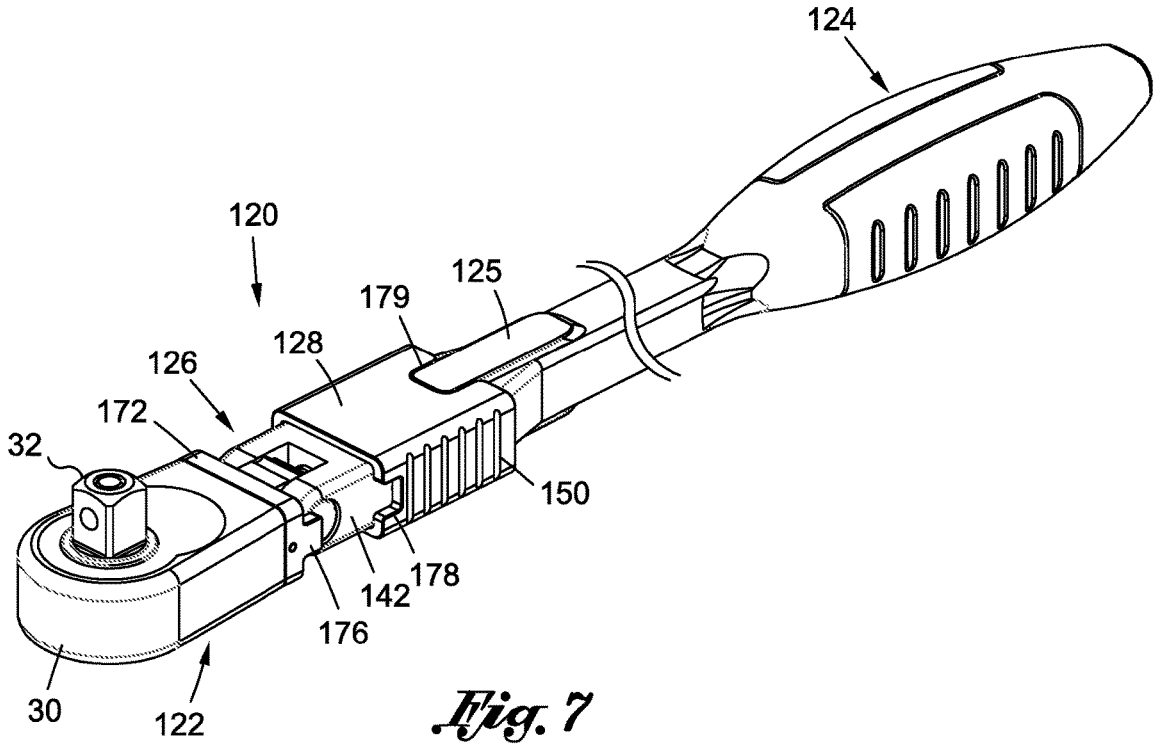

In this embodiment, the primary locking mechanism comprises a first or primary locking mechanism, such as a user-actuatable switch which is configured to actuate one or more locking members. As illustrated in FIG. 6, the switch comprises a sleeve switch 128. The sleeve switch 128 comprises a member which is mounted on the handle 124 for movement relative to the handle 124. In this embodiment, the sleeve switch 128 has the form of a sleeve or collar which is generally hollow, defining a passage through which the handle 124 extends. However, the switch could have other forms (as described below, while the sleeve is used both as an actuator for the primary locking mechanism and as a secondary locking mechanism, it is possible to have a button or other actuator for the primary locking mechanism which is different that the sleeve which is used as the secondary locking mechanism).

Preferably, the sleeve switch 128 is moveable axially along the handle 124 and includes one or more grips 150. The sleeve switch 128 is configured to selectively actuate a locking member. Referring to FIGS. 9, 10, 13, and 14, the locking member comprises an actuator 152 and at least one plunger 154. The actuator 152 comprises a body which is mounted for movement transverse to an axis of the handle 124 (and parallel to the axis of rotation of the head 122 relative to the handle 124) and a ball 161. The handle 124 further defines a recess 158 which extends generally transverse through the handle 124. The actuator 152 is generally housed within the recess 158. The ball 161 is configures to extend outwardly from the recess 158 of the handle 124 for engagement with the sleeve switch 128. In other configurations it is possible to eliminate the ball 161, such as by having an end of the actuator 152 directly engage the sleeve switch (in which case the end of the actuator 152 might be hemi-spherical or the like).

Preferably, means are provided for biasing the actuator 152 out of the recess 158 defined by the handle 124 and into engagement with an inner surface of the sleeve switch 128. In this embodiment, this means comprises a coil spring 162. The actuator 152 further defines a seat 164. The seat 164 is disposed on an area of the actuator 152 generally opposite the ball 161. In this configuration, the coil spring 162 is disposed within the handle recess 158 with one end thereof being adjacent to the seat 164. The spring 162 thus biases the actuator 152 outwardly towards the inner surface of the sleeve switch 128. The means for biasing, of course, may comprise other elements, such as other types of springs, elastic members, pressurized fluid, etc.

The actuator 152 is configured to selectively engage the plunger 154. As illustrated, the handle 124 defines a passage 166 which extends along an axis parallel to an axis of the handle 24. The passage 166 extends from the recessed area 158 to the slot between the pair of spaced flanges of the head mount 142.

The plunger 154 is mounted in the passage 166. The plunger 154 has first and second ends. The first end of the plunger 154 extends into the recess 158 for engagement with the actuator 152. The second end of the plunger may include an engaging mechanism for engaging a corresponding surface of the head mount 144. The engagement mechanism may be a projection 157 having a rounded surface, such as in a semi-circular shape. The engagement mechanism is configured to selectively engage one of a plurality of mating detents 168 in the head 122. Of course, other engaging mechanisms might be used, such as one or more teeth on the plunger 154 for engagement with one or more teeth on the head mount 144, inter-engaging pins and holes, or the like. Also, the configuration of the projection and detents might be reversed (wherein the actuator defines a detent or slot for engagement with one of a plurality of spaced projections on the handle mount).

In this embodiment, means are provided for biasing the engagement mechanism towards the head 122. As illustrated, the means comprises at least one spring 170 which is associated with the plunger 154. The at least one spring 170 preferably biases the plunger 154 towards the head 122, and thus biases the projection 157 towards the detents 168 of the head 122. Again, the means for biasing might comprise other than coil type springs, such as other types of springs or elastic members, fluid pressure, a counter mass, or the like.

The projection 157 may be moved at one or more times to a position in which it engages the head 122. In this embodiment, the head 122 defines one or more detents 168 corresponding to the projection 157. Here, the detents 168 are disposed on the end of the head mount 144. Each detent 168 preferably comprises an inwardly extending recess or depression for accepting at least a portion of the projection 157. As illustrated, multiple detents 168 may be disposed on positions around the generally arcuate end of the head mount 144, thus permitting the projection 157 to engage the head 122 in different positions, as detailed below.

As indicated above and illustrated in FIG. 14, the first end of the plunger 154 is configured to engage the actuator 152. Here, the actuator 152 has at least one first portion 188 and at least one second portion 190. The second portion 190 comprises a recessed area which permits the first end of the plunger 154 to extend or move rearwardly (away from the head 122) into the recess 158, thus allowing the projection 157 to move into and out of the detents 168 of the head 122. The first portion 188 comprises an outwardly extending portion which, when engaging the first end of the plunger 154, restricts the rearward movement of the plunger 154 from entering up into the recess 158, thus maintaining the projection 157 in engagement with one of the detents 168 of the head 122.

In this embodiment, the tool 120 also includes a secondary locking mechanism. The secondary locking mechanism comprises a collar 172 associated with the head 122. The collar 172 is configured to selectively engage the sleeve switch 128. The collar 172 is substantially similar to collar 72 described previously, and includes fasteners 174 to attach the collar 172 to the head 122 and outwardly extending tabs 176 for mating with a corresponding recesses 178 of the sleeve switch 128. As with the collar 72, when the sleeve switch 128 is moved such that the tabs 176 engage the recesses 178, rotational movement of the head 122 relative to the handle 124 is limited.

Of course, other secondary locking means may also be utilized. Also, the configuration of the sleeve might vary. For example, the sleeve switch 128 might be movable to a position in which a pin may be extended there through and into the head 122. The sleeve switch 128 might include a threaded collar which can be rotated into engagement with mating threads on the head 122. The collar 172 might comprise an integrated portion of the head 122. In general, it is desirable that the sleeve switch 128 be moveable to a position which extends over the joint 126. It is also preferable that this position of the sleeve switch 128 be maintainable (to prevent the sleeve switch 128 from unintentionally moving from over the joint 128) such as by using a locking or connecting feature.

The sleeve switch 128 may be moved to various positions. To facilitate this, the sleeve switch 128 includes a plurality of actuator engaging features. In this embodiment the sleeve switch 128 defines a first detent 182 and a second detent 184. Each detent is preferably defined on an inner surface of the sleeve switch 128 and is positioned to, at one or more times, engage the ball 161 of the actuator 152. Accordingly, in order to mate with the ball 161, the detents 182 and 184 may be generally hemispherical in shape. The detents 182 and 184 have sufficient depth to permit the actuator 152 to be biased outwardly to the position illustrated in FIG. 13 in which the plunger 154 is associated with the first portion 188 of the actuator 152. Thus, in this position, the plunger 154 and its projection 157 are maintained in engagement with one of the detents 168 of the head 22. The first and second detents 182 and 184 are similar in depth and thus both allow the actuator 152 to be biased outwardly to limit the movement of the plunger 154 into the recess 158.

Figure 10:
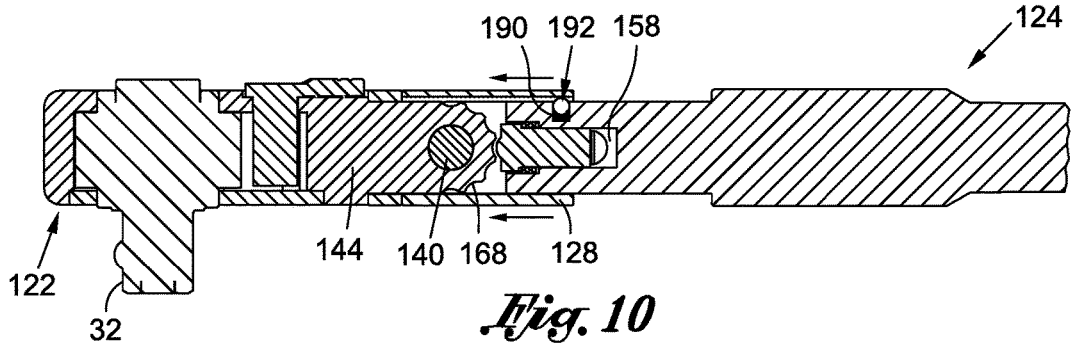
Figure 11:
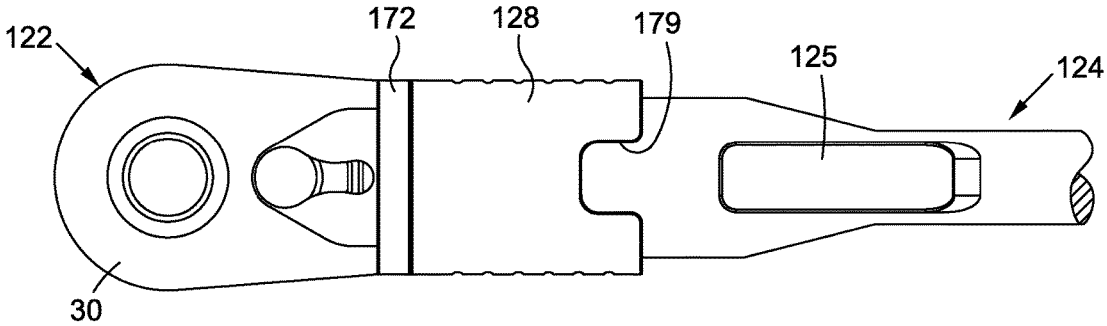

To facilitate movement of the sleeve switch 128 along the handle 124, the handle 124 may define a spacer recess 190, as illustrated in FIG. 10. A spacer 192 may be located within the recess 190 to engage the inner surface of the sleeve switch 128. In this embodiment, the spacer 192 includes a ball 194 that is biased against the inner surface of the switch sleeve 128. The engagement of the ball 194 with the inner surface of the sleeve switch 128 allows the sleeve switch 128 to slide more easily along the handle 124. The sleeve switch 128 may include a racer 196 (see FIG. 14) that corresponds to the ball 194 to further facilitate sliding of the sleeve switch 128. Although only a single recess 190 and spacer 192 are shown in FIG. 10, the handle may include multiple recesses 190 with corresponding spacers 192. For example, a second recess and spacer may be located in the handle 124 on a side opposite the recess 190. Of course, other means might be provided or utilized to facilitate movement of the sleeve switch 128 along the handle 124, such as tracks, bearing, rollers, lubrication or lubricated elements, etc.

Additional details of the tool 120 will be appreciated from a description of the operation thereof.

As with the tool 20, the position of the head 122 of the tool 120 may be changed or varied relative to the handle 124. When the sleeve switch 128 is moved to a position such that the actuator 152 may not be biased into the detents 182 and 184, the ball 161 engages with the inner surface of the sleeve switch 128. For example, the sleeve switch can be moved to a rearmost position where a rear recess 179 of the sleeve switch engages a stopper 125 of the handle 124. In this position, the ball 161 is not engaged with either detent 182 or detent 184 and is engaged with the inner surface of the sleeve switch 128. When the ball 161 is engaged with the inner surface of the sleeve switch 128, the actuator 152 is forced into the handle 124 and positioned such that the second portion 190 of the actuator 152 corresponds with the position of the first end of the plunger 154. That is, the second portion 190 is positioned so as to intersect an axis defined by the plunger 154.

The biasing spring 70 biases the plunger 154 towards the head 122 so that the projection 157 maintains contact with the head 122. When the second portion 190 of the actuator 152 is positioned to correspond with the position of the first end of the plunger 154, movement of the plunger 154 into the recess 158 is permitted. So positioned, when a user rotates the handle 124 relative the head 122, the projection 157 moves along the surface of the head 122. That is, while the projection 157 still engages the head 122, because rearward movement of the plunger 154 into the recess 158 is permitted, the projection 157 may move along the surfaces of the head 122 and in and out of the detents 168 of the head 122 as the head 122 is rotated. The engagement of the projection 157 with the head 122, however, provided tactile feedback to the user and also prevents the head 122 from flopping or swinging (i.e. aids the user in controlling the positioning of the head).

Because the primary locking mechanism is not engaged, the head 122 can be pivoted or rotated relative to the handle 124 via the joint 126. In particular, as illustrated in FIG. 9, the head 122 can be moved to a position in which it is aligned with the handle 124 and to any of other positions being aligned offset from the handle 124. The number and orientations of the positions of the handle 124 relative to the head 122 are not particularly limited and may be set, for example, according to the size and the spacing of the detents 168 of the head 122.

In this embodiment, the user may move the head 122 and the handle 124 relative to one another to a desired position. The user may then engage the primary locking mechanism in order to fix or lock the head 122 relative to the handle 124. To do so, the user slides the sleeve switch 128 along the handle 24 until the ball 161 comes into engagement with the detent 184. At this time, the actuator 152 is allowed to be biased outwardly (of the handle 124) as the ball 161 moves into the detent 184. When the ball engages the detent 184 and the actuator 152 is biased toward the detent 184, the portion 188 of the actuator 152 aligns to correspond with the plunger 154. That is, the first portion 188 is positioned so as to intersect an axis defined by the plunger 154. With the first portion 188 so positioned, the plunger 154 can't move rearwardly into the handle 124. Accordingly, when a user attempts to rotate the handle 124 relative to the head 122, the projection 157 is not permitted to move along the surface of the head 22. The projection 157 instead remains engaged with one of the detents 168 because the plunger 154 is blocked from moving into the recess 158 by the first portion 188 of the actuator 152. Thus, movement of the head 122 relative to the handle 124 is prevented.

At one or more times, the user may also engage the secondary locking mechanism. The secondary locking mechanism is particularly suited to use the tool 120 as a breaker bar. The secondary locking mechanism fixes the tool 120 in a position in which the head 22 and the handle 24 are aligned, as shown in FIGS. 10-13.

The user may move the tool 120 into the breaker bar position by moving the sleeve switch 128 to disengage the primary locking mechanism. That is, the user may move the tool 120 when the sleeve switch 129 is positioned so that the ball 161 is not engaged with detents 182 and 184. Once the tool 120 is in the breaker bar position, the user may move the sleeve switch 128 forwardly along the handle 124 towards the head until the ball 161 becomes engaged with the detent 182. As explained above, this engaged the primary locking mechanism.

Figure 12:
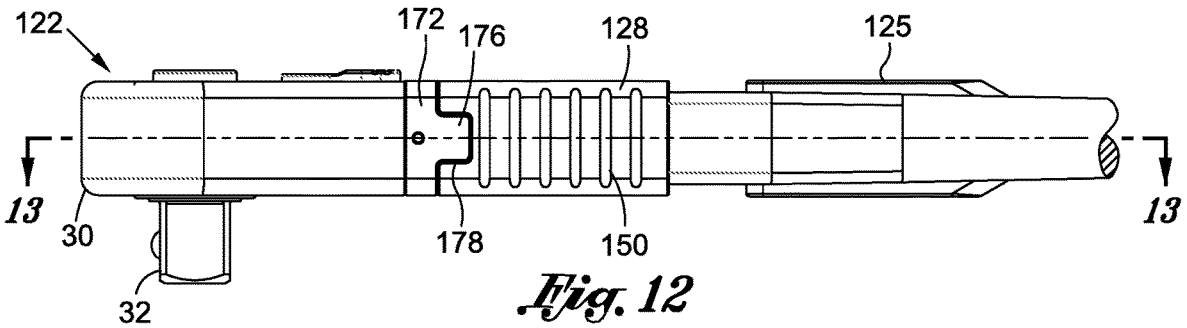
Figure 13:
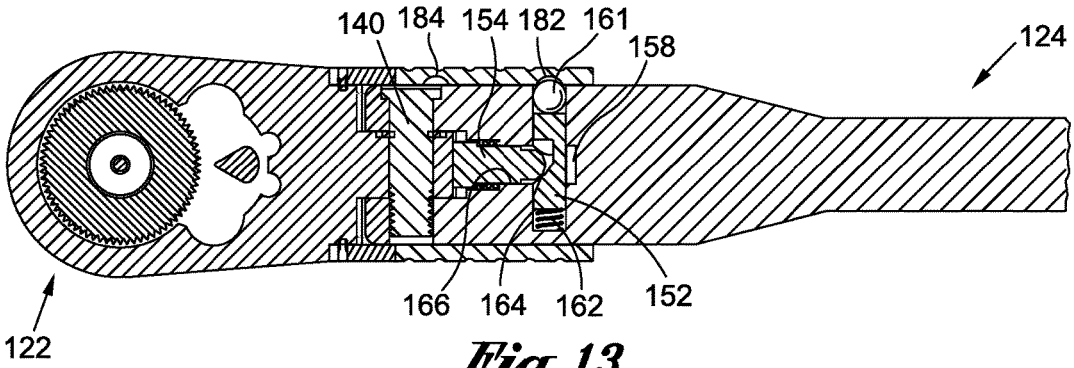

Additionally, as illustrated in FIGS. 12 and 13, the secondary locking mechanism is engaged. Specifically, the tabs 176 of the collar 172 extend into the recesses 178 of the sleeve switch 128. This engagement provides additional locking of the head 122 relative to the handle 124. As before, this locking includes an additional mechanical connection between the head 122 and the handle 124 which serves to transmit additional force between the two, thus permitting a larger force to be applied through the handle 124 to the head 122, such as when the tool 120 is to be used as a breaker bar.

Of course, in each of the disclosed embodiments, in all positions, the user may utilize the tool head 22, 122 to perform various functions. For example, when the tool head 22, 122 includes a ratcheting drive as illustrated, the user may use the tool 20, 120 to tighten or loosen various work pieces such as nuts, bolts or the like. In the event the tool head 22, 122 has other types of elements, those elements might be used for other purposes.

The tool of the invention may be constructed from various materials and have other features or elements. For example, various of the components of the tool may be constructed from metal for strength and durability purposes. However, components of the tool might be constructed from other materials. For example, as indicated, the grips might be constructed from plastic, rubber or the like. Portions of the handle may be solid or hollow. The exterior of the tool might be polished or plated.

It will be understood that the above described arrangements of apparatus and the method there from are merely illustrative of applications of the principles of this invention and many other embodiments and modifications may be made without departing from the spirit and scope of the invention as defined in the claims.

What is claimed is:

1. A hand tool comprising:

a head;

a handle being pivotably connected to the head permitting a position of the handle to be varied relative to the head from a first pivot position to a second pivot position;

a first locking mechanism configured to selectively lock the handle relative to the head in each of the first pivot position and the second pivot position; and a second locking mechanism configured to lock the handle relative to the head in only the first pivot position.

2. The hand tool of claim 1, further comprising a locking switch configured to selectively actuate both the first locking mechanism and the second locking mechanism.

3. The hand tool of claim 2, wherein the locking switch comprises a sleeve mounted on the handle, the sleeve being movable between at least a first position, a second position, and a third position, wherein when the sleeve is in the first position, the handle may pivotably rotate between the first pivot position and the second pivot position, when the sleeve is in the second position, the sleeve engages the first locking mechanism and locks the handle in one of the first pivot position or the second pivot position, and when the sleeve is the third position, the sleeve engages the second locking mechanism and locks the handle in the first pivot position.

4. The hand tool of claim 3, wherein the second locking mechanism comprises an actuator that selectively engages the second locking mechanism to lock the handle relative to the head by engagement with an interior surface profile of the sleeve.

5. The hand tool of claim 4, wherein the actuator selectively locks a plunger into engagement with detents disposed on the head to selectively lock the handle relative to the head in the first pivot position or the second pivot position.

6. The hand tool in accordance with claim 5, further comprising at least one ball that is biased by the plunger to selectively engage the detent.

7. The hand tool in accordance with claim 5, wherein the interior surface profile of the sleeve comprises at least one detent, the actuator being biased towards the interior surface, the actuator comprises a first portion and a second portion, the first portion being configured to engage with the plunger to prevent motion of the plunger towards the actuator, the second portion being configured to allow motion of the plunger towards the actuator, the actuator aligning with the at least one detent when the sleeve is in the second position allowing the actuator to move to engage the detent, and the first portion engaging with the plunger to prevent motion of the plunger towards the actuator when the actuator moves to engage the detent.

8. The hand tool of claim 3, wherein the second locking mechanism comprises a collar disposed on the head, the collar having at least one outwardly extending tab; and a recess corresponding to each of the at least one outwardly extending tab, the recess being disposed on the sleeve, wherein in the third position, the second locking mechanism is engaged by at least one outwardly extending tab engaging the corresponding recess to lock the handle relative to the head in the first position.

9. The hand tool of claim 3, wherein and interior surface of the sleeve comprises a race, the handle comprises a spacer ball disposed adjacent the race, and the spacer ball and race facilitate movement of the sleeve along the handle.

10. The hand tool in accordance with claim 1 wherein the head comprises a body having a ratchet drive.

* * * * *